US010535461B2

(12) United States Patent
Oguchi et al.

(10) Patent No.: US 10,535,461 B2
(45) Date of Patent: Jan. 14, 2020

(54) TRANSFORMER

(71) Applicant: TOYOTA JIDOSHA KABUSHIKI KAISHA, Toyota-shi, Aichi-ken (JP)

(72) Inventors: Masahiro Oguchi, Toyota (JP); Yoshiharu Matsuoka, Ichinomiya (JP); Jun Muto, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 149 days.

(21) Appl. No.: 15/808,396

(22) Filed: Nov. 9, 2017

(65) Prior Publication Data

US 2018/0144858 A1 May 24, 2018

(30) Foreign Application Priority Data

Nov. 22, 2016 (JP) ..... 2016-226945

(51) Int. Cl.
*H01F 27/28* (2006.01)

(52) U.S. Cl.
CPC ..... *H01F 27/2823* (2013.01); *H01F 27/2804* (2013.01)

(58) Field of Classification Search
CPC ..... H01F 27/2823; H01F 27/2804
USPC ..... 336/200, 232
See application file for complete search history.

(56) References Cited

U.S. PATENT DOCUMENTS

| | | | | |
|---|---|---|---|---|
| 5,353,001 | A | 10/1994 | Meinel et al. | |
| 7,414,510 | B1 * | 8/2008 | Cheng | H01F 27/2804 336/200 |
| 9,142,346 | B2 * | 9/2015 | Itou | H01F 27/325 |
| 2013/0141878 | A1 | 6/2013 | Wu et al. | |
| 2014/0292471 | A1 | 10/2014 | Ho et al. | |
| 2015/0332838 | A1 | 11/2015 | Blanke | |
| 2017/0032888 | A1 | 2/2017 | Park et al. | |

FOREIGN PATENT DOCUMENTS

| | | | |
|---|---|---|---|
| CN | 103137305 | A | 6/2013 |
| CN | 104838458 | A | 8/2015 |
| DE | 197 25 865 | A1 | 1/1998 |
| EP | 0 961 303 | A2 | 12/1999 |
| JP | 2004-303857 | A | 10/2004 |
| JP | 2005-045119 | A | 2/2005 |
| JP | 2008-004823 | A | 1/2008 |
| JP | 2012-104724 | A | 5/2012 |
| JP | 2013-89787 | A | 5/2013 |
| JP | 2015-026867 | A | 2/2015 |
| JP | 2015-118986 | A | 6/2015 |

(Continued)

*Primary Examiner* — Tszfung J Chan
(74) *Attorney, Agent, or Firm* — Oliff PLC

(57) ABSTRACT

A transformer includes: a first coil section formed by coiling a conductor pattern in a planar state around an insertion hole provided on a circuit board; a second coil section that includes a first ring composed of a coil formed by coiling a conductor plate, the coil being covered with an electric-insulating resin, a second ring composed of a coil formed by coiling a conductor plate, the coil covered with the electric-insulating resin, and a coupled part formed by covering a coupled position between the first ring and the second ring with the electric-insulating resin; and core sections forming a closed magnetic circuit that magnetically couples the first coil section and the second coil section.

3 Claims, 6 Drawing Sheets

(56) References Cited

FOREIGN PATENT DOCUMENTS

| | | | | |
|---|---|---|---|---|
| JP | 2016-127035 | A | 7/2016 | |
| KR | 10-1590132 | B1 | 2/2016 | |
| KR | 101590132 | B1 * | 2/2016 | ..... H01F 27/2804 |

* cited by examiner

TRANSFORMER

INCORPORATION BY REFERENCE

The disclosure of Japanese Patent Application No. 2016-226945 filed on Nov. 22, 2016 including the specification, drawings and abstract is incorporated herein by reference in its entirety.

BACKGROUND

1. Technical Field

The present disclosure relates to a transformer.

2. Description of Related Art

For example, Japanese Patent Application Publication No. 2008-004823 discloses a transformer having a structure that holds primary coils formed of conductor patterns on a printed circuit board between secondary coils formed of ring-shaped conductor plates.

SUMMARY

Unfortunately, in the transformer having the structure described in JP 2008-004823 A, in order to secure electric insulation between the primary coils and the secondary coils, components such as electric insulating sheets are required, for example. Consequently, in this transformer, there are such problems that the number of components becomes increased, and man-hours of component assembly also become increased.

The present disclosure provides a transformer having a structure capable of reducing the number of components, and also reducing man-hours of component assembly, while securing electric insulation between a primary coil and a secondary coil.

A transformer of a first aspect of the present disclosure includes: a first coil section formed around a insertion hole provided on a circuit board by coiling a conductor pattern by one round or more in a planar state; a second coil section that includes a first ring composed of a coil formed by coiling a conductor plate by one round or more, the coil being covered with an electric-insulating resin, the first ring being annular and being arranged on a first surface of the circuit board such that a core of the first ring coincides with a core of the first coil section, a second ring composed of a coil formed by coiling a conductor plate by one round or more, the coil being covered with the electric-insulating resin, the second ring being annular and being arranged on a second surface of the circuit board such that a core of the second ring coincides with the core of the first coil section, and a coupled part formed by covering a coupled position between the first ring and the second ring with the electric-insulating resin; and core sections inserted through the insertion hole, the first coil section, and the second coil section, core sections holding the circuit board from both sides of the circuit board so as to form a closed magnetic circuit that magnetically couples the first coil section and the second coil section.

According to the first aspect of the present disclosure, as the second coil section, there is employed a shape formed by coupling the annular first ring composed of a coil covered with the electric insulating resin and the annular second ring composed of a coil covered with the electric insulating resin to each other. Hence, it is possible to insert the core sections that are magnetic cores through respective holes extending through the first ring and the second ring after being resin-molded so that the core sections can be fixed. Through this, it becomes unnecessary to prepare a bobbin around which the wire is coiled as a different component. Accordingly, it is possible to reduce the number of components of the transformer, and also reduce man-hours of component assembly.

In addition, according to the first aspect of the present disclosure, the second coil section (one of the primary coil and the secondary coil) is covered with the electric-insulating resin. Through this, it is possible to secure electric insulation between the first coil section and the second coil section that is required for the transformer in a state in which the second coil section is assembled to the first coil section (the other of the primary coil and the secondary coil).

In the transformer of the first aspect of the present disclosure, the circuit board may include a slit, the coupled part being inserted and fitted into the slit so as to position the first coil section and the second coil section such that the core of the first coil section coincides with a core of the second coil section.

In the first aspect of the present disclosure, when the second coil section is assemble to the circuit board where the first coil section is formed, the circuit board is provided with the slit for positioning the first coil section and the second coil section such that the core of the first coil section coincides with the core of the second coil section. A part (the coupled part) where the first ring and the second ring of the second coil section are coupled to each other is inserted and fitted into the slit of the circuit board until the coupled position abuts to the end portion of the slit.

Through this, the assembling work with less components allows the core of the first coil section and the core of the second coil section to readily coincide with each other, and to secure coaxial accuracy of the holes into which the core sections are inserted, that is, coaxial accuracy between the through-hole of the circuit board and the through hole of the second coil section. Accordingly, it is possible to enhance assemblability of the core suction after the second coil section is fixed to the circuit board.

In the first aspect of the present disclosure, the conductor plate may be a rectangular copper wire.

In the first aspect of the present disclosure, there may be a gap between the first ring and the second ring, and the circuit board may be disposed in the gap.

As aforementioned, according to the transformer of the present disclosure, it is possible to reduce the number of components, and also reduce man-hours of component assembly, while securing electric insulation between the primary coil and the secondary coil.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

[Outline]

A transformer of the present disclosure is configured such that each of air core coils around Which a coil wire (conductor plate) is coiled is covered with an electric-insulating resin in a manner as to have a hole through which a core as a magnetic core is to be inserted. Hence, coil components after being resin-molded can be fixed by inserting cores thereof as magnetic cores through the holes. This configuration eliminates necessity of preparing a bobbin around which the coil wire is coiled as a separate component. Accordingly, it is possible to reduce the number of components of the transformer, and also reduce man-hours of component assembly.

[Structure of each Component]

First, with reference to FIG. 1 and FIG. 2, each of components composing the transformer 1 according to one embodiment of the present disclosure will be described.

Figure 1:
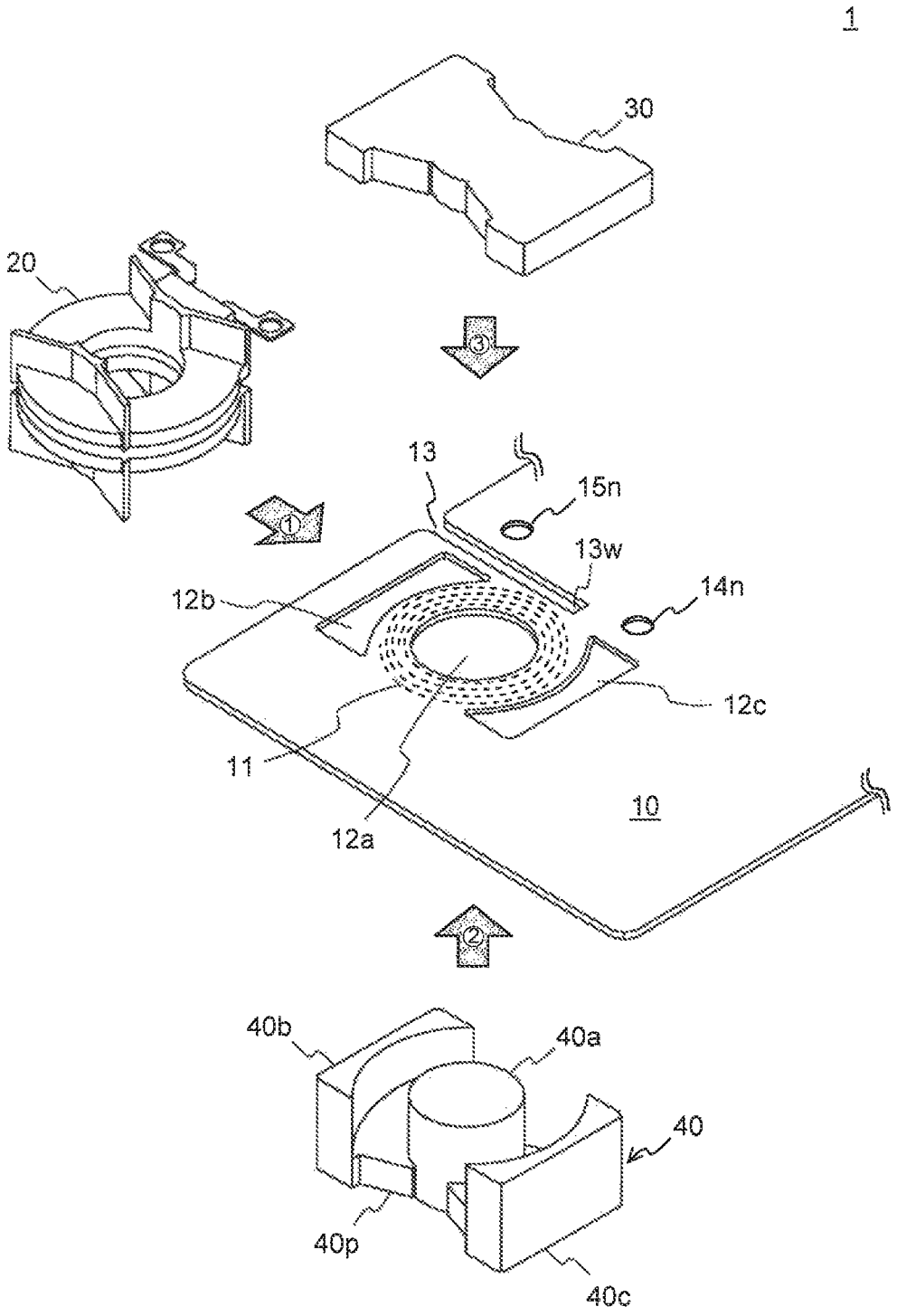
FIG. 1 is an exploded view of components of a transformer according to one embodiment of the present disclosure.

FIG. 1 is a view explaining the structure of the transformer 1 according to one embodiment of the present disclosure with the components of the transformer developed. The transformer 1 exemplified in FIG. 1 is composed of the following components: a circuit board 10 where a first coil section 11 is formed, a second coil section 20, an upper core section 30, and a lower core section 40. FIG. 2 is a view explaining a more detailed structure of the second coil section 20 in FIG. 1.

The transformer 1 according to the present embodiment is formed by assembling the following components: the second coil section 20, the upper core section 30, and the lower core section 40, respectively to the circuit board 10 (the first coil section 11) in numerical order indicated in respective arrows from respective directions of these arrows shown in FIG. 1. This assembling method will be described later.

The transformer 1 assembled in this manner becomes an element having a structure in which the first coil section 11 and the second coil section 20 are magnetically coupled with each other via the upper core section 30 and the lower core section 40.

Circuit Board 10 and First Coil Section 11.

The circuit board 10 is a print circuit board on which conductor patterns allowing electricity to flow therethrough are printed, and wire-connects surface mounted components and others by the conductor patterns so as to configure a predetermined electric circuit. This circuit board 10 may have a multiple layer structure or a single layer structure.

The circuit board 10 is provided with an insertion hole 12*a* through which a center leg portion 40*a* of the lower core section 40 described later is inserted, an insertion hole 12*b* through which an outer leg portion 40*b* of the lower core section 40 is inserted, and an insertion hole 12*c* through which an outer leg portion 40*c* of the lower core section 40 is inserted, respectively.

A conductor pattern in a coil shape is so formed as to be coiled around the insertion hole 12*a* of the circuit board 10 by one round or more in a planar state. If the circuit board 10 has a multiple layer structure, a coiled conductor pattern may be formed in each layer. The first coil section 11 formed by this coiled conductor pattern composes a coil on a higher-voltage side in the transformer 1.

The circuit board 10 is provided with a slit 13 into which a coupled part 24*c* of the second coil section 20 described later is inserted. This slit 13 is formed to facilitate positioning of the first coil section 11 and the second coil section 20 such that cores thereof coincide with each other by inserting and fitting the coupled part 24*c* into the slit 13 until the coupled part 24*c* abuts to an end portion 13*w* located at an innermost position of the slit 13.

In addition, the circuit hoard 10 is provided with screw holes 14*n*, 15*n* used for fixing and connecting, to the circuit board 10, a first connecting terminal 21*t* and a second connecting terminal 22*t* of the second coil section 20 in which the coupled part 24*c* is inserted and fitted to the slit 13.

Second Coil Section 20

The second coil section 20 composes a coil on a lower-voltage side of the transformer 1. This second coil section 20 has a structure (resin-mold structure) in Which a conductor formed by connecting two coils 21 and to each other at a coupled position 23 is covered with a resin (electric-insulating resin) 24 having an electric insulation property, as shown in FIG. 2.

Each of the coil 21 and the coil 22 is an air core coil formed of a conductor plate such as a rectangular copper wire, coiled by one round (edgewise coil), for example. The coil 21 and the coil 22 are formed with the same coil inner diameter and the same coil outer diameter. The coil 21 and the coil 22 are electrically coupled to each other at a coupled position 23 such that both cores thereof coincide with each other, in substantially parallel to each other with a predetermined distance therebetween. The predetermined distance is designed to be any dimension that allows a predetermined gap 24*g* to be formed between a first ring 24*u* and a second ring 24*d* that are covered with the electric-insulating resin 24 described later.

The first connecting terminal 21*t* extending to the outside of the electric-insulating resin 24 is connected to the coil 21. This first connecting terminal 21*t* is provided with a screw hole 21*n*. A second connecting terminal 22*t* extending to the outside of the electric-insulating resin 24 is connected to the coil 22. This second connecting terminal 22*t* is provided with a screw hole 22*n*.

The coil 21 is covered with the electric-insulating resin 24 so as to have a predetermined thickness around the circumference of the coil 21, to thereby form the annular first ring 24*u* having a through-hole inside the coil. The coil 22 is so covered with the electric-insulating resin 24 as to have a predetermined thickness around the circumference of the coil 22, to thereby form the annular second ring 24*d* having a through-hole inside the coil. In addition, the coupled position 23 where the coil 21 and the coil 22 are coupled to each other is covered with the electric-insulating resin 24 so as to have a predetermined thickness around the circumference of the coupled position 23, to thereby form a coupled part 24*c*. The coil 21 and the coil 22 are molded in a manner as to form the predetermined gap 24*g* between the first ring 24*u* and the second ring 24*d*. The predetermined gap 24*g* is designed to have a dimension that allows the circuit board 10 to be inserted thereinto (a thickness equal to or greater than that of the circuit board 10). The coupled position 23 is molded such that the coupled part 24*c* has a thickness not greater than the width of the slit 13 provided to the circuit board 10.

A pair of V-shaped first guide ribs 24*ur* between which the upper core section 30 is to be fitted and fixed is erected on a surface of the first ring 24*u* opposite to the gap 24*g*. The first guide ribs 24*ur* are formed in a manner as to correspond to the outer shape of the upper core section 30 so that inner surfaces facing each other of the first guide ribs 24*ur* are engaged with side surfaces of the upper core section 30. In addition, a pair of V-shaped second guide ribs 24*dr* between which the lower core section 40 is to be fitted and fixed is erected on a surface of the second ring 24*d* opposite to the gap 24*g*. These second guide ribs 24*dr* are formed in a manner as to correspond to the outer shape of the lower core section 40 so that inner surfaces facing each other of the second guide ribs 24*dr* are engaged with side surfaces of the lower core section 40.

Figure 2:
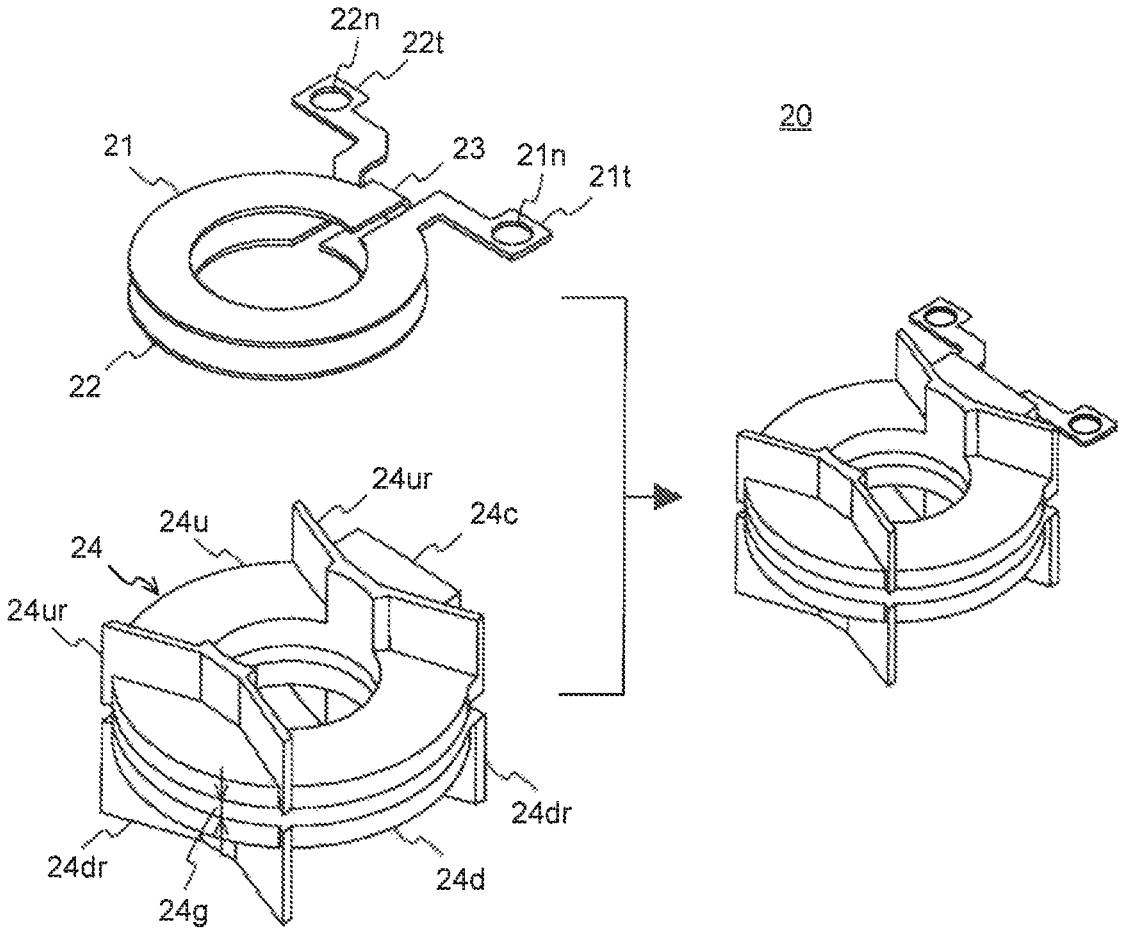
FIG. 2 is a view explaining a detailed structure of a second coil section shown in FIG.

In the example of FIG. 2, there has been explained the case in which each of the coil 21 and the coil 22 is formed by coiling the conductor plate by one round. However, each of the coil 21 and the coil 22 may be formed by coiling the conductor plate by two rounds or more, or the coil 21 and the coil 22 may have different coiling rounds from each other.

Upper Core Section 30 and Lower Core Section 40

The upper core section 30 is a so-called I-shaped core that is in a flat plate-like and butterfly shape in a plan view, and is made of a magnetic material such as a ferrite material, fir example. The upper core section 30 is formed to have one pair of side surfaces whose center portions are recessed so as to be engaged with the pair of first guide ribs 24*ur* erected on the surface of the first ring 24*u* of the second coil section 20.

The lower core section 40 is a so-called E-shaped core that is made of a magnetic material such as a ferrite material, and has a main body 40*p* in a flat plate-like and butterfly shape in a plan view, the center leg portion 40*a*, the outer leg portion 40*b*, and the outer leg portion 40*c*. The main body 40*p* is formed to have one pair of side surfaces whose center portions are recessed so as to be engaged with the pair of second guide ribs 24*dr* erected on the surface of the second ring 24*d* of the second coil section 20. The outer leg portion 40*b* is erected at one longitudinal end of the main body 40*p* such that the outer leg portion 40*b* can be inserted through the insertion hole 12*b* of the circuit board 10. The outer leg portion 40*c* is erected at the other longitudinal end of the main body 40*p* such that the outer leg portion 40*c* can be inserted through the insertion hole 12*c* of the circuit board 10. The center leg portion 40*a* is erected between the outer leg portion 40*b* and the outer leg portion 40*c* such that the center leg portion 40*a* can be inserted through the insertion hole 12*a*. The center leg portion 40*a*, the outer leg portion 40*b*, and the outer leg portion 40*c* are formed from the main body 40*p* at the same height so that respective end surfaces thereof become parallel to the main body 40*p*.

In the upper core section 30 and the lower core section 40, when the end surfaces of the respective leg portions of the lower core section 40 are joined to one flat surface of the upper core section 30, a closed magnetic circuit (closed magnetic path) through which a magnetic flux passing through the coiled wire of the first coil section 11 and the coiled wire of the second coil section 20 passes is formed by the center leg portion 40*a* and the outer leg portion 40*b*, and center leg portion 40*a* and the outer leg portion 40*c*.

[Assembling Method of Respective Components]

Next, with reference to FIG. 1, the assembling procedure of the respective components to form the transformer 1 according to the present embodiment will be described.

First, the second coil section 20 is assembled to the circuit board 10 from the direction indicated by the arrow (1) in FIG. 1. At this time, the coupled part 24*c* is inserted into the slit 13 while the circuit board 10 is inserted into the gap 24*g* between the first ring 24*u* and the second ring 24*d*. The second coil section 20 is inserted until the coupled part 24*c* abuts to the end portion 13*w* located at the innermost position of the slit 13.

Through this, the first ring 24*u* of the second coil section 20 is arranged on one surface (in the upward direction of the drawing) of the circuit board 10 in such a manner that the core of the first ring 24*u* coincides with the core of the first coil section 11; and the second ring 24*d* of the second coil section 20 is arranged on the other surface (in the downward direction of the drawing) of the circuit board 10 in such a manner that the core of the second ring 24*d* coincides with the core of the first coil section 11. This means that the second coil section 20 is positioned relative to the circuit board 10 such that the core of the first coil section 11 formed on the circuit board 10 and the core of the second coil section 20 coincide with each other. The screw holes 14*n* and 15*n* provided to the circuit board 10 coincide with the screw holes 21*n* and 22*n* provided respectively to the first connecting terminal 21*t* and the second connecting terminal 22*t* of the second coil section 20, and thus screw clamp can be carried out.

Next, the lower core section 40 is assembled to the circuit board 10 to which the second coil section 20 is assembled, from the direction indicated by the arrow (2) in FIG. 1, that is, from a direction where the second ring 24*d* of the second coil section 20 is located. At this time, the side surfaces of the lower core section 40 are fitted so as to be engaged with the pair of guide ribs 24*dr* erected on the surface of the second ring 24*d* of the second coil section 20, to thereby insert the center leg portion 40*a* of the lower core section 40 into the insertion hole 12*a* of the circuit board 10, the outer leg portion 40*b* of the lower core section 40 into the insertion hole 12*b* of the circuit board 10, and the outer leg portion 40*c* of the lower core section 40 into the insertion hole 12*c* of the circuit board 10, respectively.

Through this, the respective end surfaces of the center leg portion 40*a*, the outer leg portion 40*b*, and the outer leg portion 40*c* of the lower core section 40 come into a state of projecting from the surface of the first ring 24*u* of the second coil section 20.

Finally, the upper core section 30 is assembled to the circuit board 10 where the second coil section 20 and the lower core section 40 have already been assembled, from the direction indicated by the arrow (3) in FIG. 1, that is, from the direction where the first ring 24*u* of the second coil section 20 is located. At this time, the side surface of the upper core section 30 is fitted to be engaged with the pair of first guide ribs 24*ur* erected on the surface of the first ring 24*u* of the second coil section 20.

Through this, while being inserted through the insertion hole 12*a*, the through-hole of the first coil section 11, and the through-hole of the second coil section 12, and also holding the first coil section 11 and the second coil section 20 from the both sides of the circuit board 10, the respective end surfaces of the center leg portion 40*a*, the outer leg portion 40*b*, and the outer leg portion 40*c* of the lower core section 40 are joined to one flat surface of the upper core section 30. Accordingly, it is possible to form the closed magnetic circuit that magnetically couples the first coil section 11 and the second coil section 20 to each other, by the upper core section 30 and the lower core section 40.

[Structure of Transformer]

Figure 4:
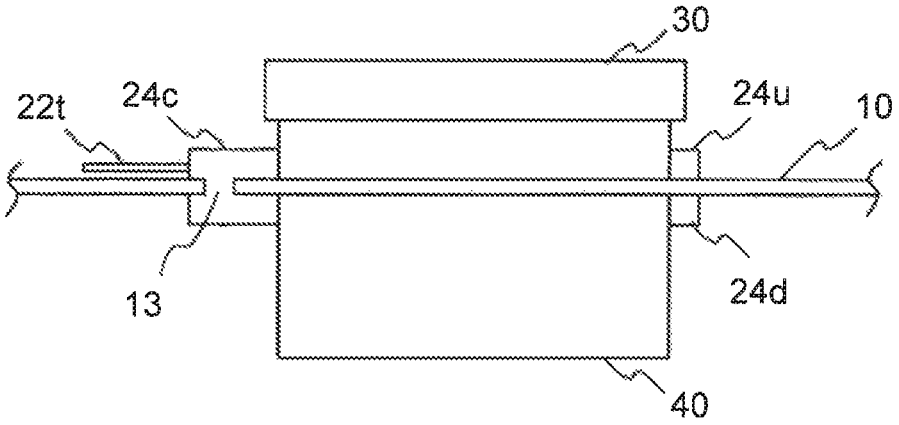
FIG. 4 is an arrow view of the transformer in FIG. 3, taken in the direction of an arrow A.
Figure 5:
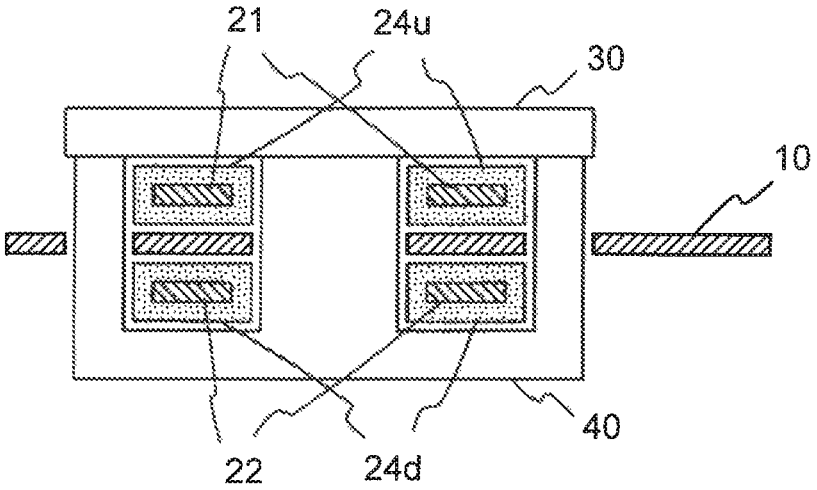
FIG. 5 is a cross sectional view of the transformer in FIG. 3, taken along line V-V.

Next, further with reference to FIG. 3 to FIG. 5, the structure of the transformer 1 in a state in which the circuit board 10 (the first coil section 11), the second coil section 20, the upper core section 30, and the lower core section 40 are assembled in the above manner will be described.

Figure 3:
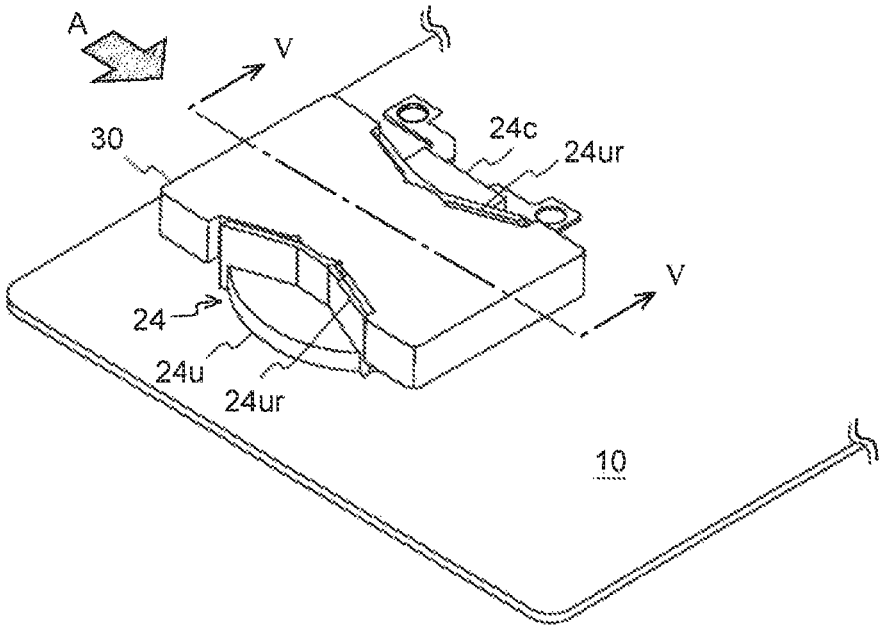
FIG. 3 is a perspective view showing a state of the transformer installed on a circuit board.

FIG. 3 is a perspective view showing a state of the transformer 1 formed by assembling the respective components. FIG. 4 is a view of the transformer 1 in FIG. 3, as viewed from a point A in the arrow direction. FIG. 5 is a view of the transformer 1 in FIG. 3, taken along V-V line and as viewed in the arrow direction.

As shown in the respective drawings, the transformer 1 to which the respective components are assembled and mounted to the circuit board 10 has a total thickness by summing the thickness of the upper core section 30 and the thickness of the lower core section 40. In the transformer 1, the circuit board 10 is held by the first ring 24*u* of the second coil section 20 and the second ring 24*d* of the second coil section 20, In the transformer 1, the coupled part 24*c* of the second coil section 20 is inserted in the slit 13 of the circuit board 10.

[Operational Effect of Embodiments]

As described above, according to the transformer 1 of one embodiment of the present disclosure, there is used the second coil section 20 having a shape such that the annular first ring 24*u* having a through-hole and composed of the coil 21 covered with the electric-insulating resin 24, and the annular second ring 24*d* having a through-hole and composed of the coil 22 covered with the electric-insulating resin 24 are coupled at the coupled part 24*c*, Hence, the upper core section 30 and the lower core section 40 that are the magnetic cores can be inserted into and fixed to the through-holes of the first ring 24*u* and the second ring 24*d* after being resin-molded. Through this, it becomes unnecessary to prepare a bobbin around which the coil wire is coiled as a different component. Hence, it is possible to reduce the number of components of the transformer 1, and also reduce man-hours of component assembly.

In addition, according to the transformer 1 of one embodiment of the present disclosure, the second coil section 20 is covered with the electric-insulating resin 24. Through this, it is possible to secure electric insulation between the first coil section 11 and the second coil section 20 required for the transformer 1 while the second coil section 20 is assembled to the first coil section 11 formed on the circuit board 10.

According to the transformer 1 of one embodiment of the present disclosure, each of the coil 21 and the coil 22 that are the conductor of the second coil section 20 are formed by a conductor plate having a wider width such as a rectangular copper wire. Through this, it is possible to suppress increase in wiring resistance on the second coil section 20 side that is caused in accordance with increase in voltage conversion rate. Accordingly, a radiating mechanism that should be required for heat suppression becomes unnecessary; thus it is possible to reduce the number of components of the transformer 1.

According to the transformer 1 of one embodiment of the present disclosure, the first coil section 11 is formed by utilizing the conductor pattern on the circuit board 10 coiled around the insertion hole 12*a* by one round or more in a planar state. Through this, the first coil section 11 can be set by using a multiple-round wire; thus it is possible to configure the transformer 1 having a coiling ratio depending on the high voltage conversion rate.

According to the transformer 1 of one embodiment of the present disclosure, the coupled part 24*c* between the first ring 24*u* and the second ring 24*d* of the second coil section is inserted and fitted into the slit 13 until the coupled part 24*c* abuts to the end portion 13*w* of the slit 13 formed in the circuit board 10, to thereby position the first coil section 11 and the second coil section 20 to each other. Through this, it is possible to readily allow the core of the first coil section 11 and the core of the coil 22 to coincide with each other. That is, it is possible to secure coaxial accuracy of the insertion hole 12*a* of the circuit board 10 into which the center leg portion 40*a* of the lower core section 40 is inserted, relative to the through-holes of the first ring 24*u* and the second ring 24*d* of the second coil section 20. Accordingly, the assemblability of the lower core section 40 after the second coil section 20 is assembled to the circuit board 10 is enhanced.

Furthermore, according to the transformer 1 of one embodiment of the present disclosure, the circuit board 10 is inserted into the gap 24*g* of the second coil section 20 so as to assemble the first coil section 11 and the second coil section 20 to each other. That is, this is a structure that holds the first coil section 11 between the first ring 24*u* and the second ring 24*d* of the second coil section 20. With this structure, there is a possibility to reduce the dimension of the transformer 1 (particularly, a total thickness thereof when the first coil section 11 and the second coil section 20 are held by the upper core section 30 and the lower core section 40). Since the magnetic coupling between first coil section 11 and the second coil section 20 can be tight, to thereby reduce the number of components such as a radiation mechanism for heat suppression and electronic components for suppressing electric stress (surge), and others.

Figure 6A:
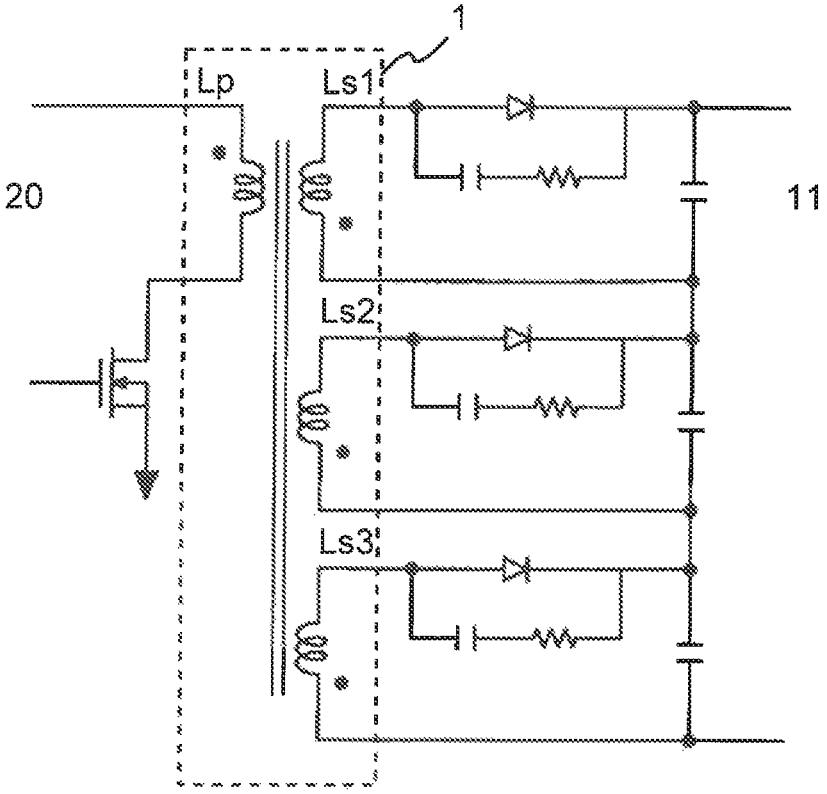
FIG. 6A shows an example of a circuit configuration using a structure of the transformer according to the present embodiment.
Figure 6B:
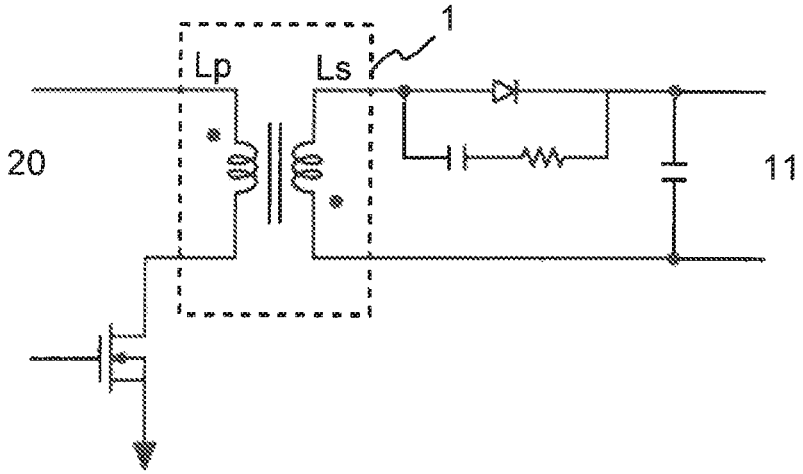
FIG. 6B shows an example of a circuit configuration using the structure of the transformer according to the present embodiment.
Figure 6C:
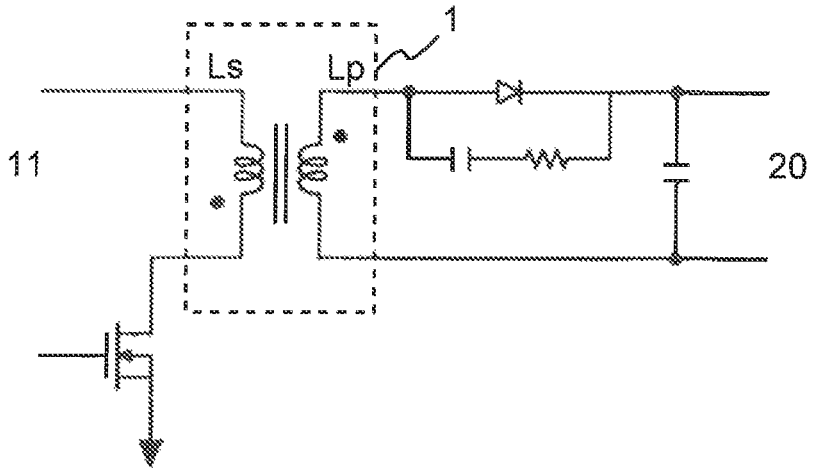
FIG. 6C shows an example of a circuit configuration using the structure of the transformer according to the present embodiment.

In the transformer 1 according to one embodiment of the present disclosure, it is possible to freely design how many first coil sections 11 on the higher-voltage side are used, or which of the first coil section 11 on the higher-voltage side and the second coil section 20 on the lower-voltage side is set to be the primary coil or the secondary coil. For example, as shown in FIG. 6A, the circuit board 10 having a multiple layer structure may be used so as to configure three first coil sections 11. For example, as shown in FIG. 6B, a step-up transformer may be configured such that the primary coil of the transformer 1 is composed of the second coil section 20 as the lower-voltage side, and the secondary coil of the transformer 1 is composed of the first coil section 11 as the higher-voltage side. Furthermore, for example, as shown in FIG. 6C, a step-down transformer may be configured such that the primary coil of the transformer 1 is composed of the first coil section 11 as the higher-voltage side, and the secondary coil of the transformer 1 is composed of the second coil section 20 as the lower-voltage side.

The transformer of the present disclosure is usable in a solar power generation system, for example, and is useful particularly in the case in which it is desired to reduce the number of components and man-hours of component assembly while securing the electric insulation between the primary coil and the secondary coil,

What is claimed is:

1. A transformer comprising:

a first coil section formed by coiling a conductor pattern by one round or more in a planar state around an insertion hole provided on a circuit board;

a second coil section that includes a first ring composed of a coil formed by coiling a conductor plate by one round or more, the coil being covered with an electric-insulating resin, the first ring being annular and being arranged on a first surface of the circuit board such that a through-hole of the first ring coincides with an insertion hole of the first coil section, a second ring composed of a coil formed by coiling a conductor plate by one round or more, the coil being covered with the electric-insulating resin, the second ring being annular and being arranged on a second surface of the circuit board such that a through-hole of the second ring coincides with the insertion hole of the first coil section, and a coupled part formed by covering a coupled position between the first ring and the second ring with the electric-insulating resin, the coupled position electrically coupling the respective coils between the first ring and the second ring; and core sections inserted through the insertion hole, the first coil section, and the second coil section, the core sections holding the circuit board from both sides of the circuit board so as to form a closed magnetic circuit that magnetically couples the first coil section and the second coil section, wherein the circuit board includes a slit, the coupled part being inserted and fitted into the slit so as to position the first coil section and the second coil section such that the insertion hole of the first coil section coincides with a through-hole of the second coil section.

2. The transformer according to claim 1, wherein the conductor plate is a rectangular copper wire.

3. The transformer according to claim 1, wherein a gap exists between the first ring and the second ring, and the circuit board is disposed in the gap.

* * * * *